United States Patent [19]

Bischofberger et al.

[11] Patent Number: 4,581,510

[45] Date of Patent: Apr. 8, 1986

[54] DRIVE FOR A HIGH-TENSION CIRCUIT BREAKER

[75] Inventors: Walter Bischofberger, Niederweningen, Switzerland; Horst Plettner, Hanau, Fed. Rep. of Germany; Kristof Zakowski, Zurich; Norbert Zeller, Ennetbaden, both of Switzerland

[73] Assignee: BBC Brown Boveri & Co., Ltd., Switzerland

[21] Appl. No.: 584,329

[22] Filed: Feb. 28, 1984

[30] Foreign Application Priority Data

Mar. 1, 1983 [CH] Switzerland ..... 1121/83
Nov. 30, 1983 [CH] Switzerland ..... 6399/83

[51] Int. Cl.[4] ..... H01H 33/54
[52] U.S. Cl. ..... 200/148 F; 200/82 B
[58] Field of Search ..... 200/148 R, 148 F, 144 AP, 200/82 B

[56] References Cited

U.S. PATENT DOCUMENTS 2,676,285 4/1954 Jansson et al. ..... 200/148 F
3,655,931 4/1972 Circle ..... 200/82 B

FOREIGN PATENT DOCUMENTS 2745343 4/1979 Fed. Rep. of Germany .
436431 11/1967 Switzerland ..... 200/82 B

*Primary Examiner*—Robert S. Macon
*Attorney, Agent, or Firm*—Ostrolenk, Faber, Gerb & Soffen

[57] ABSTRACT

An electrical high-tension circuit breaker with main contacts and auxiliary contacts in parallel to the main contacts. Both sets of contacts are actuated by hydraulic drives which are fed from a hydraulic accumulator. The drive of this circuit breaker is of high reliability and small size considering the power to be switched. This is achieved with a main drive which contains a piston-cylinder arrangement which can be pressurized with hydraulic fluid via a main valve and a secondary drive which is actuated via a valve arrangement. The valve arrangement is controllable as a function of the position of the main contacts and/or the auxiliary contacts. With this drive, failure-susceptible elements, such as catches, mechanical dampers and couplings, are avoided. The drive is preferably for high-tension circuit breakers for voltages above 220 kV.

12 Claims, 3 Drawing Figures

DRIVE FOR A HIGH-TENSION CIRCUIT BREAKER

BACKGROUND OF THE INVENTION

The invention relates to a drive for a high-tension circuit breaker.

A drive of this type is known for instance from German Offenlegungsschrift No. 2,745,343 published Apr. 12, 1979. In the case of this drive, connection of the main contacts causes oil to be compressed by a piston secured on the actuating rod of the drive and guided in a cylinder. The compressed oil drives the movable resistance contacts of the auxiliary switching points of two make-resistors, guided in a piston-cylinder arrangement, against two compression springs and energises these resistors a few milliseconds earlier than the main contacts. The entire energy involved here for the movement of the main and auxiliary contacts as well as for the charging of the compression springs, becoming active on disconnection, must be provided by a single drive. This drive must therefore not only be of relatively large design, it is also subjected to high loading.

SUMMARY OF THE INVENTION

The object of the invention is to create a drive of the generic type distinguished by great reliability at a size relatively small in relation to the connected power.

A drive of this type can be designed in extremely space-saving and inexpensive configuration even for use in high-tension circuit breakers of very high power and is distinguished not only by simple assembly, easy maintenance and long service life but also in particular by the fact that it makes large contact strokes possible. This favours its use as a drive for switches with main and resistance contacts in grids with voltages above 220 kV.

Hydraulic drives for high-tension circuit breakers have admittedly already been known for some time and described for instance in a forementioned German Offenlegungsschrift No. 2,948,379, but these drives serve solely for switching the main contacts.

BRIEF DESCRIPTION OF THE DRAWINGS

Further advantages of the invention are disclosed in the following description of an exemplary embodiment shown in the drawing in which.

DETAILED DESCRIPTION OF PREFERRED EMBODIMENT

Figure 1:
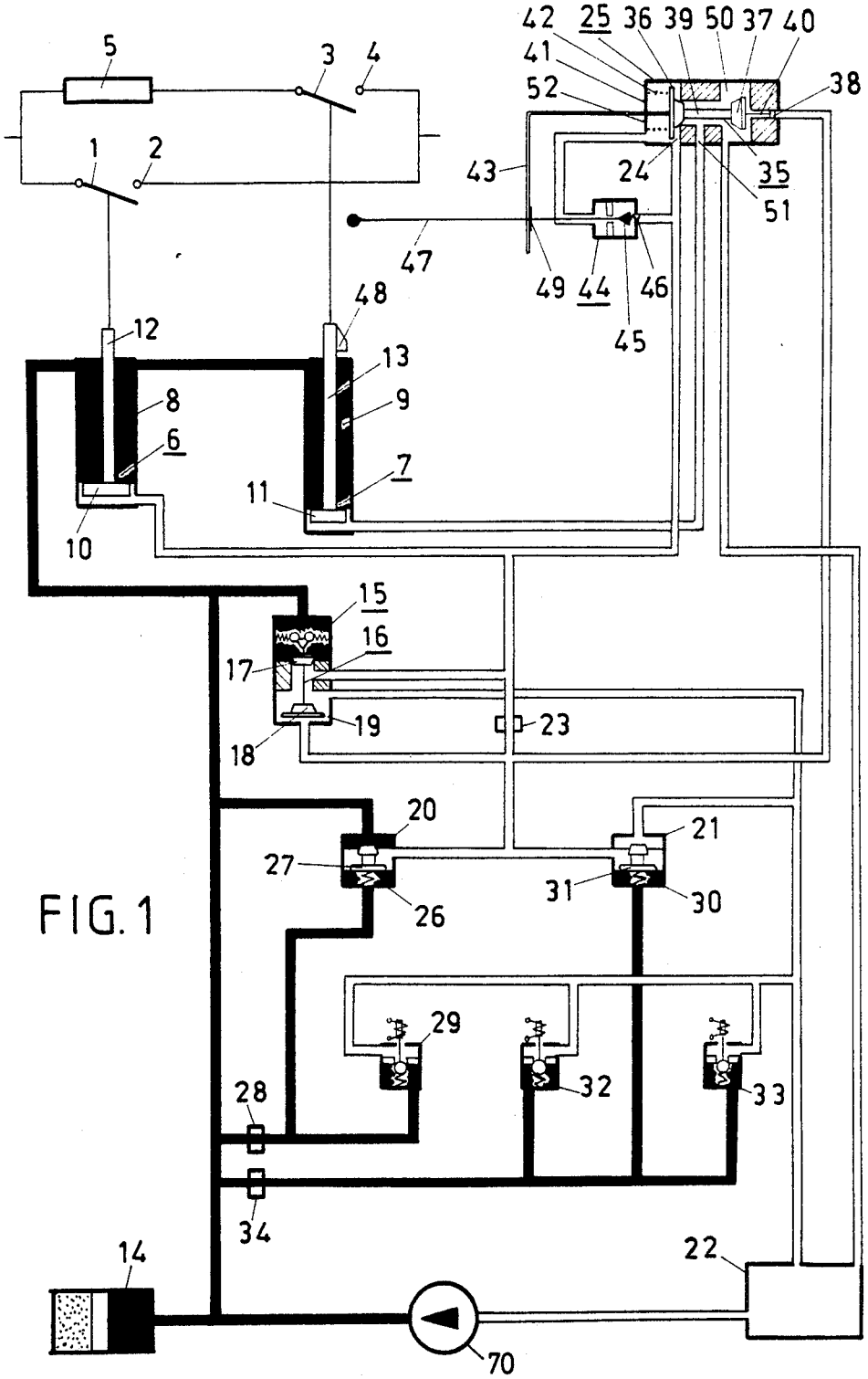
FIG. 1 shows a circuit diagram of a first embodiment of a drive designed according to the invention for a high-tension circuit breaker with a make-resistor.

In the hydraulic drive shown in FIG. 1, hydraulic fluid under high pressure is represented in black and hydraulic fluid under low pressure in white. This drive is intended for the main contacts 1, 2 and the resistance contacts 3, 4 of a high-tension circuit breaker (not shown) in the disconnected position, with a make-resistor 5. It displays two piston-cylinder arrangements 6 and 7, respectively, each with an hydraulic cylinder 8 and 9, respectively, and a differential piston 10 and 11, respectively. Differential piston 10 is coupled in force-closed connection via a piston rod 12 with the movable contact of the two main contacts 1, 2, differential piston 11 being similarly coupled via a piston rod 13 with the movable contact of the two resistance contacts 3, 4. The two partial spaces of hydraulic cylinders 8, 9 above the smaller effective areas of differential pistons 10, 11 are joined to an hydraulic-fluid high-pressure source, for example a pneumatically pressurised hydraulic accumulator 14. The partial space of hydraulic cylinder 8 below the larger effective area of differential piston 11 is joined to an outlet of a main valve 15.

The main valve 15 displays a valve body 16 with an inlet valve body 17 and an outlet valve body 18. The valve bodies 17 and 18 are rigidly joined together by means of a valve rod. The outlet valve body 18 displays an hydraulic piston and is arranged in a valve chamber 19, designed as an hydraulic cylinder, which is in connection with the outlets of amplifier valves 20 and 21. The inlet of main valve 15 is joined to the hydraulic accumulator 14, a further outlet being joined to a low-pressure accumulator 22. The inlet valve body 17 is arranged in such a way that in the unpressurised state of valve chamber 19 it blocks the path between inlet and the two outlets. The outlet of main valve 15 is joined to hydraulic cylinder 8 and additionally joins, via a throttle point 23 the valve chamber 19 to an inlet 24 of a control block 25.

The amplifier valve 20 is joined on the inlet side, to hydraulic accumulator 14 and has a valve chamber 26, designed as an hydraulic cylinder, with a spring-loaded valve body 27, designed as a displaceable piston. This valve chamber 26 is joined to the inlet of a magnetically actuated make valve 29 and, via a throttle point 28, to hydraulic accumulator 14.

Amplifier valve 21 is joined on the outlet side to low-pressure accumulator 22 and has a valve chamber 30, designed as an hydraulic cylinder, with a spring-loaded valve body 31, designed as a displaceable piston. Valve chamber 30 is joined to the inlets of two magnetically actuated break-valves 32, 33 and, via a throttle point 34, to hydraulic accumulator 14. Throttle points 28, 34 serve to supply a flow of hydraulic fluid under high pressure after a certain time delay following actuation of one of the valves 29, 32 or 33 and an associated brief pressure relief of valve chambers 26 or 30 of amplifier valves 20 or 21.

The outlets of make-valve 29 and break-valves 32 and 33 are joined to low-pressure accumulator 22. Hydraulic accumulator and low-pressure accumulator 22 are joined together via a pump device 70.

Control block 25 displays a valve body 35 with an inlet valve body 36, and outlet valve body 37 and a control valve body 38. Valve bodies 36 and 37 and valve bodies 37 and 38 are joined together rigidly via a rod 39, or a rod 40, respectively.

Inlet valve body 36 is a piston and is arranged in a valve chamber 41, designed as an hydraulic cylinder. On the side facing away from inlet 24, it is loaded by a spring 42 and joined to a linkage 43, extending from control block 25. Valve chamber 41 is connected to a non-return valve 44, the valve body 45 of which, located between a valve seat and a further connection, is loaded by a spring 46 and is joined to an actuating rod 47 led out of the non-return valve 44. This rod 47 is arranged in such a way that, shortly before the end of the make-stroke of piston rod 13, it moves valve body 45 against the force of spring 46, by means of a cam 48 mounted on piston rod 13, and thereby opens non-return valve 44. Valve chamber 41 is then joined to main valve 15. A stop 49 is arranged on actuating rod 47 in such a way that this stop is supported on linkage 43 and thus allows non-return valve 44 to remain open against the force of spring 46 via actuating rod 47 as long as the inlet valve body 36 is pressed against its valve seat.

Control valve body 38 is likewise designed as a piston and is arranged in a valve chamber (not marked in the figure), connected to the outlet of amplifier valve 20 and the inlet of amplifier valve 21 and designed as an hydraulic cylinder.

Outlet valve body 37 is provided in a valve chamber 50, containing the outlet to low-pressure accumulator 22, and is arranged in such a way that, in the unpressurised state of the valve chamber containing the control valve body 38, it joins the outlet to low-pressure accumulator 22 to a connection 51 of control block 25, which is connected to the partial space of hydraulic cylinder 9 located below the larger effective piston area of differential piston 11. When the valve chamber containing the control valve body 38 is pressurised and valve chamber 41 is in the unpressurised state, outlet valve body 37 however blocks the path between hydraulic cylinder 9 and low-pressure accumulator 22.

The mode of operation of this drive is consequently as follows:

For energising the high-tension circuit breaker, make-valve 29 is actuated. With a small delay of a few milliseconds, the movement of the main and resistance contacts (FIG. 3) then begins. This involves low-pressure accumulator 22 being briefly joined, via inlet valve 29, to valve chamber 26 of amplifier valve 20. The high pressure of the hydraulic fluid being exerted in valve chamber 26 is reduced and valve body 27 moves from its valve seat against the force of the spring by the hydraulic force acting on the upper area of valve body 27, so that hydraulic fluid under high pressure is passed via amplifier valve 20 into valve chamber 19 of main valve 15 and into the valve chamber, provided with the control valve body 38, of control block 25. Due to appropriate dimensioning of the effective areas, a greater force acts on the outlet valve body 18 removed from its valve seat in the disconnected state than on inlet valve body 17, so that the latter is raised from its valve seat and hydraulic fluid under high pressure can pass into the partial space of hydraulic cylinder 8 located under the greater effective piston area as well as to outlet 24 of control block 25.

Figure 3:
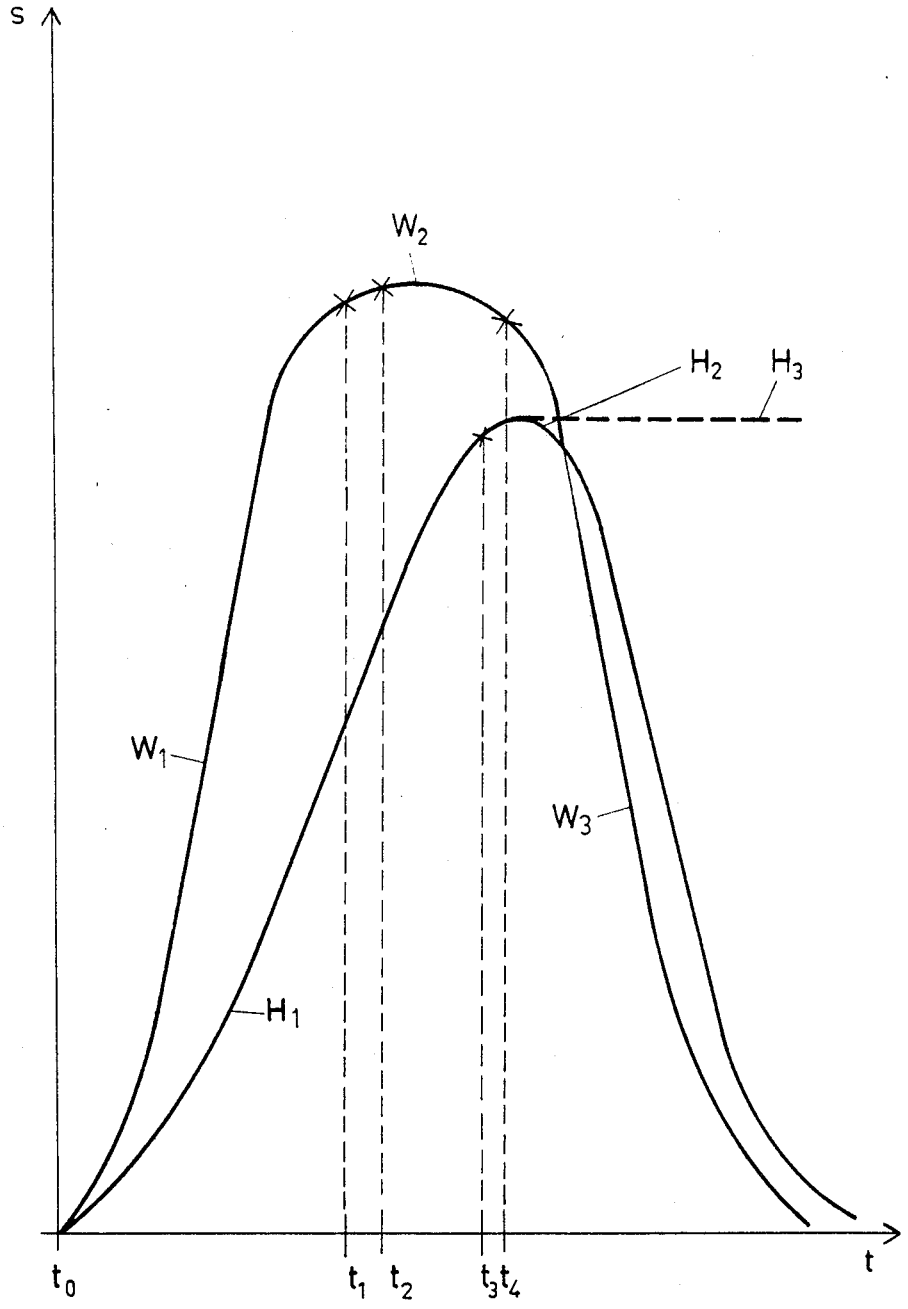
FIG. 3 shows a displacement (s)/time (t) diagram of the contacts moved by the drives according to FIGS. 1 and 2 with a CO connection of the hightension circuit breaker.

Differential piston 10 is moved upwards and the two main contacts 1, 2 are thereby moved closer together (curve section $H_1$ in FIG. 3). At the same time, hydraulic fluid under high pressure also enters the partial space of hydraulic cylinder 9 located under the greater effective piston area and likewise moves differential piston 11 upwards, causing the two resistance contacts 3, 4 to be moved closer together (cf. curve section $W_1$ in FIG. 3). This simultaneous movement of differential piston 11 is possible since inlet valve body 36 has cleared the path from inlet 24 to piston cylinder 9. This clearance is conditional upon appropriate dimensioning of the effective piston area of control valve body 38 such that the hydraulic force acting on control valve body 38 is greater than the force of spring 42 and the hydraulic force which is necessary to take a proportion of the hydraulic fluid volume located in valve chamber 41 out of this chamber via the loaded non-return valve 44. As soon as inlet 24 is clear, non-return valve 44 is closed by the hydraulic fluid under high pressure flowing out.

As can be seen in FIG. 3, hydraulic cylinders 8, 9 are dimensioned in such a way that, although the movable contact of the two resistance contacts 3, 4 has a greater stroke, it moves faster and is contacted at an earlier time than the movable contact of the two main contacts 1, 2. At time $t_1$, resistance contacts 3, 4 contact each other and the stroke of the moving resistance contact is then delayed considerably.

A few milliseconds later, namely at time $t_2$, cam 48 strikes actuating rod 47 and effects opening of non-return valve 44. Hydraulic fluid under high pressure passes into valve chamber 41 and, due to the greater effective piston area of inlet valve body 36 in relation to control valve body 38, moves valve body 35 to the right. The path from main valve 15 to hydraulic cylinder 9 is now interrupted, whilst the path from hydraulic cylinder 9 to low-pressure accumulator 22 is open, so that the pressure in the partial space of hydraulic cylinder 9 positioned underneath the greater effective piston area is reduced rapidly and differential piston 11, and thus the movable resistance contact, reaches its maximum stroke and then reverses its direction of movement (curve section $W_2$ in FIG. 3). In the course of further movement, now directed downwards, of the movable contact of the two resistance contacts 3, 4, cam 48 again loses engagement with actuating rod 47. Non-return valve 44 remains open, however, as stop 49 is supported on linkage 43 due to the displacement of valve body 35 to the right.

At time $t_3$, main contacts 1, 2 close and a few milliseconds later, at time $t_4$, resistance contacts 3, 4 open. As valve chamber 19 is supplied with hydraulic fluid under high pressure via throttle point 23, main valve 15 remains open and main contacts 1, 2 therefore remain energised (cf. curve section $H_3$ in FIG. 3).

With brief energising of the high-tension circuit breaker (CO connection), a disconnect instruction is given to one of the two break-valves 32, 33 even before the maximum stroke of main contacts 1, 2 is reached. This involves low-pressure accumulator 22 being briefly joined to valve chamber 30 of amplifier valve 21 via one of the two break-valves 32 or 33. The high pressure of the hydraulic fluid being exerted in valve chamber 30 is reduced and valve body 31 moves from its valve seat against the force of the spring by the hydraulic force acting on the upper area of valve body 31, thereby creating a connection from valve chamber 19 to low-pressure accumulator 22 via amplifier valve 21. In valve chamber 19, the high pressure exerted by this is reduced and valve body 16 is moved downwards. Inlet valve body 17 blocks the path from hydraulic accumulator 14 to hydraulic cylinder 8, and at the same time outlet valve body 18 clears the path for the hydraulic fluid, located in hydraulic cylinder 8 and in valve chamber 41 of control block 25, to low-pressure accumulator 22. Differential piston 10, and therefore the movable contact of the two main contacts 1, 2, reverse their directions of movement and now move downwards (curve section $H_2$ in FIG. 3).

Since in disconnection not only valve chambers 19 but also the valve chamber containing control valve body 38 are pressure-relieved, spring 42 can keep the path from hydraulic cylinder 9 to low-pressure accumulator 22 open so that differential piston 11 can move downwards unhindered and resistance contacts 3, 4 can thereby be completely opened (curve section $W_3$ in FIG. 3) so that the positions of the contacts and valves given in FIG. 1 are produced again.

Figure 2:
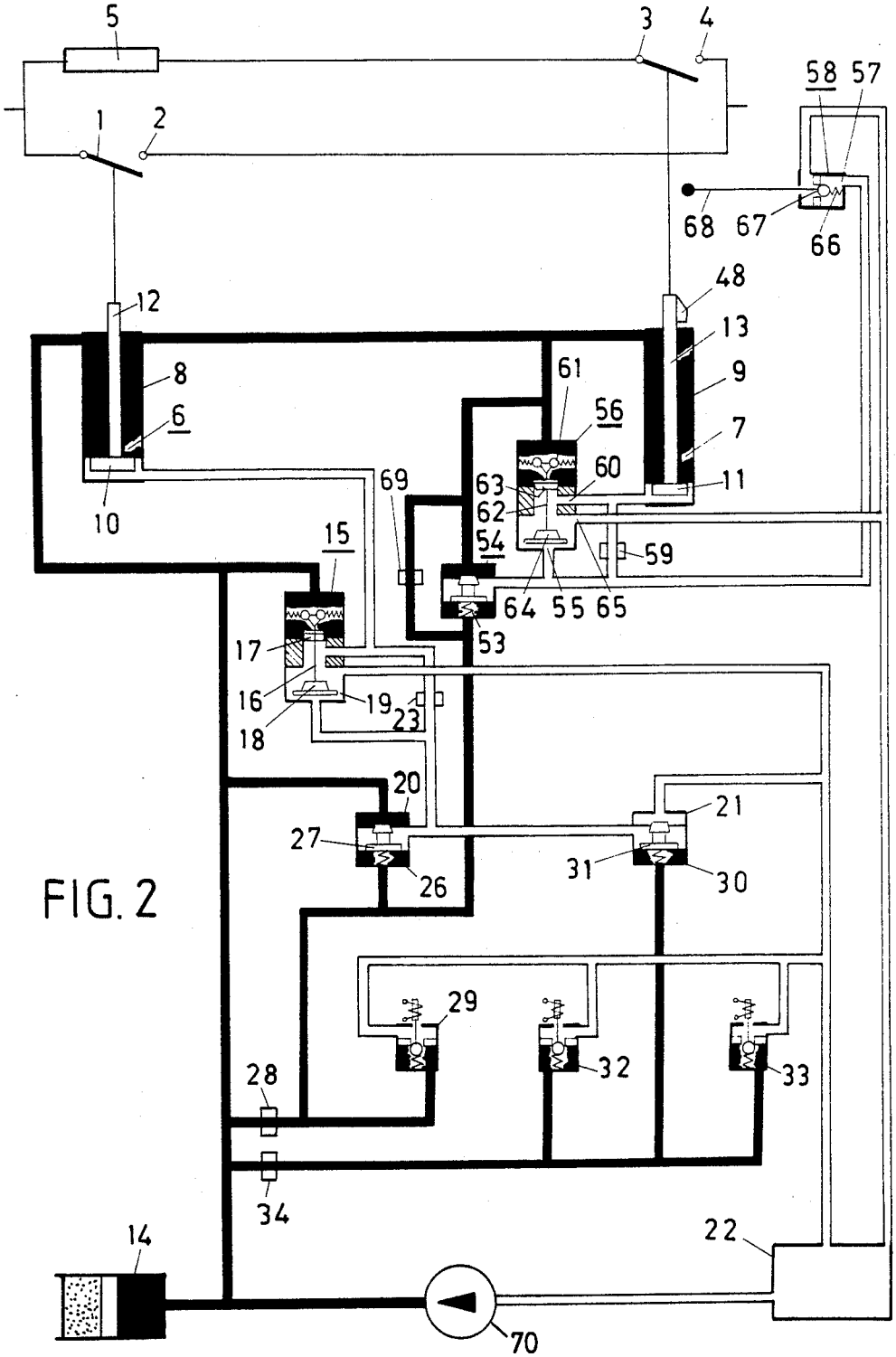
FIG. 2 shows a circuit diagram of a second embodiment of a drive designed according to the invention for a high-tension circuit breaker with a make-resistor.

In the case of the further embodiment of the drive according to the invention, shown in FIG. 2, hydraulic fluid under high pressure is likewise represented in black and hydraulic fluid under low pressure is likewise in white and the same parts as in the embodiment according to FIG. 1 are provided with the same reference numbers. Unlike the embodiment according to FIG. 1, valve chamber 26 of amplifier valve 20 is connected to a valve chamber 53 of an amplifier valve 54 designed equivalent to valves 20 and 21. Amplifier valve 54 is connected on the inlet side with hydraulic accumulator 14 and on the outlet side is joined to a valve chamber 55 of a main valve 56, an inlet 57, a non-return valve 58 and to an outlet 60 of main valve 56 via a throttle point 59.

The main valve 56 is designed equivalent to main valve 15 and has an inlet 61 in connected with hydraulic accumulator 14 as well as a valve body 62 with an inlet valve body 63 and an outlet valve body 64. Valve bodies 63 and 64 are rigidly joined together via a valve rod. On outlet valve body 64, there is an hydraulic piston provided, which is arranged in valve chamber 55, designed as an hydraulic cylinder. Outlet 60 of main valve 56 is joined to the part of hydraulic cylinder 9 located under the greater area of differential piston 11, a further outlet 65 being joined to low-pressure accumulator 22.

Non-return valve 58 is designed equivalent to non-return valve 44 and has a valve body 67 loaded by a spring 66, which body is rigidly joined to an actuating rod 68 led out of non-return valve 58. Equivalent to the embodiment according to FIG. 1, the actuating rod 68 is also arranged in such a way that, shortly before the end of the make-stroke of piston rod 13, it moves valve body 67 against the force of spring 66 by means of the cam 48 arranged on piston rod 13, and thereby openg non-return valve 58.

Between valve chamber 53 and the inlet of amplifier valve 54 (not marked) there is, furthermore, a throttle point 69 provided, via which valve chamber 53 is constantly supplied with hydraulic fluid under high pressure, so that after brief pressure relief—for instance via make-valve 29—valve chamber 53 is rapidly repressurised by hydraulic fluid under high pressure.

Upon energising this arrangement, make-valve 29 is actuated and starts the movement of main and resistance contacts equivalent to the drive according to FIG. 1 with a slight delay of a few milliseconds. This involves low-pressure accumulator 22 being briefly joined to valve chamber 26 of amplifier valve 20 via inlet valve 29. The high pressure of the hydraulic fluid being exerted in valve chamber 26 is reduced and valve body 27 is moved from its valve seat against the force of the spring by the hydraulic force acting on the upper area of valve body 27, so that hydraulic fluid under high pressure is passed into valve chamber 19 of main valve 15 via amplifier valve 20. At the same time as valve 20, amplifier valve 54 also opens and hydraulic fluid under high pressure flows into valve chamber 55 of main valve 56 as well as to inlet 57 of non-return valve 58. Due to appropriate dimensions of the effective areas, a greater force acts on the outlet valve bodies 18 and 64 removed from their valve seats in the disconnected state and on the inlet valve bodies 17 and 63, so that the latter are raised from their valve seats and hydraulic fluid under high pressure can enter into the partial spaces located under the larger effective piston areas of hydraulic cylinders 8 and 9.

Differential pistons 10 and 11 are now moved upwards and thus the two main contacts 1, 2 (curve section $H_1$ in FIG. 3) and the two resistance contacts 3, 4 (curve section $W_1$ in FIG. 3) are moved closer together.

Corresponding to the drive according to FIG. 1, hydraulic cylinders 8, 9 are dimensioned in such a way that, although the movable contact of the two resistance contacts 3, 4 has a greater stroke, it moves faster and is contacted at an earlier time than the movable contact of the two main contacts 1, 2. At time $t_1$, resistance contacts 3, 4 contact each other and the speed of the moving resistance contact is then reduced considerably.

A few milliseconds later, namely at time $t_2$, cam 48 strikes actuating rod 68 and effects opening of non-return valve 58. The hydraulic fluid under high pressure available at inlet 57 is passed via non-return valve 58 into low-pressure accumulator 22, valve chamber 55 of main valve 56 being pressure-relieved and the supply of hydraulic fluid under high pressure into the partial space of hydraulic cylinder 9 located under the larger effective piston area is interrupted by closing of main valve 56. After the closing of main valve 56, outlets 60 and 65 are joined together and now the pressure in the partial space of hydraulic cylinder 9 lying under the larger effective piston area can be rapidly reduced. Differential piston 11 and, thus, the movable resistance contact reach their maximum stroke and then reverse their directions of movement (curve section $W_2$ in FIG. 3). In the course of further movement, now directed downwards, of the movable contact of the two resistance contacts 3, 4, cam 48 again loses engagement with actuating rod 68, so that non-return valve 58 is closed again under the effect of spring 66.

At time $t_3$, main contacts 1, 2 close and a few milliseconds later, at time $t_4$, resistance contacts 3, 4 open. As valve chamber 19 is supplied with hydraulic fluid under high pressure via throttle point 23, main valve 15 remains open and main contacts 1, 2 therefore remain energised (cf. curve section $H_3$ in FIG. 3), whereas resistance contacts 3, 4 are completely opened (cf. curve section $W_3$ in FIG. 3).

With brief energising of the high tension circuit breaker (CO connection), main contacts 1, 2 follow curve section $H_2$ in FIG. 3, equivalent to the main contacts in the exemplary embodiment according to FIG. 1, so that finally the states of the contacts and valves with open circuit breaker given in FIG. 2 are produced again.

Compared with the drive according to FIG. 1, this drive additionally displays the advantage that simple and standarised as well as hydraulically self-holding valves, such as amplifier valves, non-return valves and main valves can be used for control of the piston-cylinder arrangement of resistance contacts 3, 4. Since the same valves are furthermore also used in some cases for control of the piston-cylinder arrangement of main contacts 1, 2, stockkeeping and production costs are reduced. As the hydraulic fluid for the drive of the main contacts and resistance contacts is fed to hydraulic cylinders 8 and 9 via two separate main valves 15 and 56, main valve 15 merely requires an adequate passage cross-section for the fluid supply to hydraulic cylinder 8 of main contacts 1, 2. For connecting up the drives of main contacts and resistance contacts, not 4, but just 3 hydraulic lines are needed.

The invention is of course not restricted to the drives described in the exemplary embodiments. It is, for example, possible to fit cam 48 on piston rod 12, indicating the position of main contacts 1, 2, instead of on piston rod 13. If actuating rod 47 or 68 is designed such that at time $t_2$ it engages with the cam fitted on piston rod 12, non-return valves 44 or 58 can be driven in analogy with the exemplary embodiments described above.

Moreover, in the case of the exemplary embodiment according to FIG. 1, it is possible to integrate non-return valve 44 in control block 25, for instance by designing an outer wall 52 of valve chamber 41 as the valve seat of valve body 45 and allowing it to bear the housing of non-return valve 44. Valve body 45 is then advantageously designed as a plunger led out of the housing, upon the outer plunger head of which, led out of the housing, actuating rod 47 is attached.

With appropriate adaptation of the movement sequences of the movable main contacts 1, 2 relative to the movable resistance contacts 3, 4 - for instance by means of appropriate dimensioning of the associated piston-cylinder arrangements 6, 7 - the invention is limited not to only the actuation of make-resistors, but the actuated resistor can also be designed as a break-resistor or even as a make-and-break-resistor.

We claim:

1. A drive mechanism for actuating main contacts and auxiliary contacts connected in parallel with said main contacts of a high-tension voltage circuit breaker, said mechanism comprising:

a first piston-cylinder arrangement having a first piston rod which is coupled to and movable to open and close said main contacts;

a first main valve coupled to said piston-cylinder arrangement for controllably supplying pressurized hydraulic fluid from a hydraulic accumulator to operate said first piston-cylinder arrangement;

means for actuating said first main valve;

a second piston-cylinder arrangement having a second piston rod coupled to and movable to open and close said auxiliary contacts; and a valve arrangement for operating said second piston-cylinder arrangement which includes:

(i) a second main valve having a first position for connecting said second piston-cylinder arrangement to said hydraulic accumulator and a second position for connecting said second piston-cylinder arrangement to a low pressure container having a pressure lower than said pressurized hydraulic fluid;

(ii) a controllable valve coupled to said low pressure container and to said second main valve, said controllable valve having a first position for connecting a valve chamber of said second main valve to said low pressure container to thereby cause said second main valve to enter its said second position and a second position for isolating said valve chamber from said low pressure container to thereby cause said second main valve to enter its said first position; and (iii) means for causing said controllable valve to switch from its said first and second positions in response to the spatial position of one of said first and second piston rods.

2. The mechanism of claim 1, wherein said valve arrangement further comprises an amplifier valve for operating said second main valve, said first amplifier having an inlet which is coupled to said accumulator and an outlet which is coupled to said valve chamber of said second main valve, said amplifier further having a valve chamber coupled to a make control valve which is operable to actuate said amplifier valve.

3. The mechanism of claim 2, further comprising:

a first throttle element located between an outlet and said valve chamber of said second main valve;

a second throttle element located between said inlet and said outlet of said amplifier valve; and a third throttle located between an outlet associated with said first piston-cylinder arrangement and a valve chamber of said first main valve.

4. The mechanism of claim 1, 2 or 3, wherein said controllable valve is a non-return valve which includes an actuating rod which is actuated by the movement of said second piston rod.

5. The mechanism of claim 1, 2 or 3, wherein said controllable valve is a non-return valve and includes an actuating rod which is actuated by the movement of said first piston rod.

6. The mechanism of claim 1 or 2, in which said first and second piston-cylinder arrangements have unequal effective piston areas, said effective piston areas being such that said second piston rod of said second piston-cylinder arrangement moves faster and thereby closes said auxiliary contacts before said main contacts are closed.

7. A drive mechanism for actuating main contacts and auxiliary contacts connected in parallel with said main contacts of a high-tension voltage circuit breaker, said mechanism comprising:

a first piston-cylinder arrangement having a first piston rod which is coupled to and movable to open and close said main contacts;

a main valve coupled to said first piston-cylinder arrangement for controllably supplying pressurized fluid from a hydraulic accumulator to operate said first piston-cylinder arrangement;

means for actuating said main valve;

a second piston-cylinder arrangement having a second piston rod coupled to and movable to open and close said auxiliary contacts; and a valve arrangement for operating said second piston-cylinder arrangement which includes:

(i) a control block having a housing which defines first, second, and third chambers, and inlet, outlet and control valve bodies which are movable, respectively, in said first, second and third chambers in response to hydraulic pressures applied thereto;

(ii) a control valve for supplying said pressurized fluid to said first chamber, said control valve being actuated in response to the position of at least one of said first and second piston rods;

(iii) means, coupled to said third chamber, for initiating the making and breaking of said circuit breaker; and (iv) an inlet into said control block, said inlet communicating with said main valve and said control valve, said second chamber communicating with said low pressure container.

8. The mechanism according to claim 7, wherein said controllable valve is a non-return valve which includes an actuating rod which is actuated by the movement of said second piston rod.

9. The mechanism according to claim 7, wherein said controllable valve is a non-return valve which includes an actuating rod which is actuated by the movement of said first piston rod.

10. The mechanism according to claim 7 or 8, in which said non-return valve is mounted within said housing of said control block, said non-return valve comprising a valve body having a plunger which emerges from said valve housing.

11. The mechanism according to claim 7 or 8, further comprising a stop on said actuating rod and a linkage supported at said inlet valve body of said control block and extending between said inlet valve body and said stop, said stop being supported on said linkage.

12. The mechanism according to claim 7 or 8, further comprising a cam mounted to said second piston rod, said cam being positioned to engage said actuating rod when said second piston rod has caused the closing of said auxiliary contacts but before said main contacts are closed.

* * * * *